US007222441B2

(12) United States Patent
Smith et al.

(10) Patent No.: US 7,222,441 B2
(45) Date of Patent: May 29, 2007

(54) SANDAL WITH INTERCHANGEABLE UPPER

(76) Inventors: Rudolph Smith, 9036 Keith Ave., Los Angeles, CA (US) 90096; Anthony Glenn Alfino, 355 Kendall Rd., Buellton, CA (US) 93427

( * ) Notice: Subject to any disclaimer, the term of this patent is extended or adjusted under 35 U.S.C. 154(b) by 306 days.

(21) Appl. No.: 10/894,890

(22) Filed: Jul. 19, 2004

(65) Prior Publication Data

US 2005/0016019 A1 Jan. 27, 2005

Related U.S. Application Data

(63) Continuation-in-part of application No. 10/000,979, filed on Oct. 30, 2001, now Pat. No. 6,763,614, which is a continuation-in-part of application No. 09/605,418, filed on Jun. 27, 2000, now Pat. No. 6,351,897.

(51) Int. Cl.
*A43B 23/26* (2006.01)

(52) U.S. Cl. ..... 36/11.5; 36/100

(58) Field of Classification Search ..... 36/15, 36/11.5, 100, 101

See application file for complete search history.

(56) References Cited

U.S. PATENT DOCUMENTS

| | | | | |
|---|---|---|---|---|
| 2,200,080 A | | 5/1940 | Fein | |
| 2,367,232 A | * | 1/1945 | Marx | 36/11.5 |
| 2,368,314 A | * | 1/1945 | Marx | 36/11.5 |
| 2,444,640 A | | 7/1948 | Epstein | |
| 2,526,940 A | * | 10/1950 | Fello | 36/11.5 |
| 3,154,866 A | * | 11/1964 | Laufbahn | 36/101 |
| 3,204,346 A | | 9/1965 | Lockard et al. | |
| 4,616,432 A | | 10/1986 | Bunch et al. | |
| 4,811,497 A | | 3/1989 | Merino Ciudad | |
| 4,839,948 A | * | 6/1989 | Boros | 24/662 |
| 4,887,369 A | * | 12/1989 | Bailey et al. | 36/101 |
| 5,177,882 A | | 1/1993 | Berger | |
| 5,557,866 A | | 9/1996 | Prengler | |
| 5,896,684 A | * | 4/1999 | Lin | 36/101 |
| 5,992,058 A | * | 11/1999 | Jneid | 36/100 |
| 6,349,486 B1 | * | 2/2002 | Lin | 36/101 |
| 6,430,846 B1 | * | 8/2002 | Lin | 36/101 |
| 2003/0145490 A1 | * | 8/2003 | Tsai | 36/15 |

* cited by examiner

*Primary Examiner*—Marie Patterson
(74) *Attorney, Agent, or Firm*—David A. Belasco; Belasco Jacobs & Townsley, LLP

(57) ABSTRACT

The sandal with interchangeable upper includes a sole portion and an instep enclosing section. The instep enclosing section is removably attached at first and second side edges adjacent the inner and outer edges of the sole portion, respectively. When the instep enclosing section is removed from the sole portion, a second section can be substituted for the first instep enclosing section. The instep enclosing section is attached to the sole portion using at least one pair of side hooks. These side hooks are sized and shaped to removably engage a pair of hook engagers located in the sole portion. The hook engagers are moved from a first, engaging position to a second disengaging position by at least one engager actuator. The side hooks and hook engagers may be vertically or horizontally oriented. An alternative instep enclosing has a toe-separating portion secured to the sides and front of the sole portion.

32 Claims, 5 Drawing Sheets

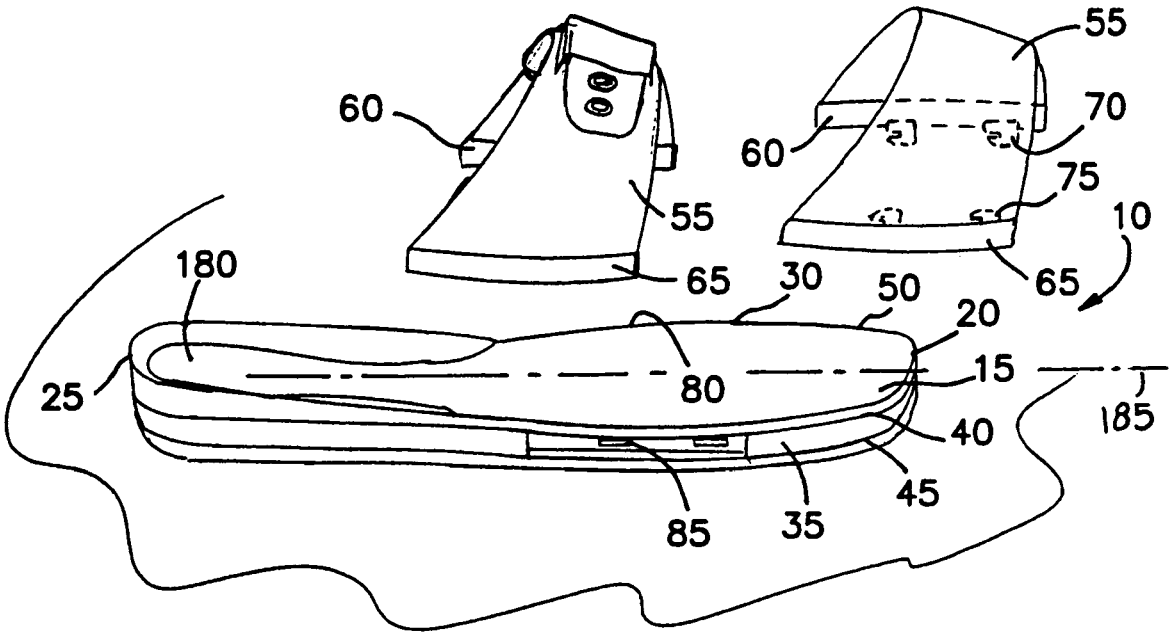
FIG. 1
FIG. 2
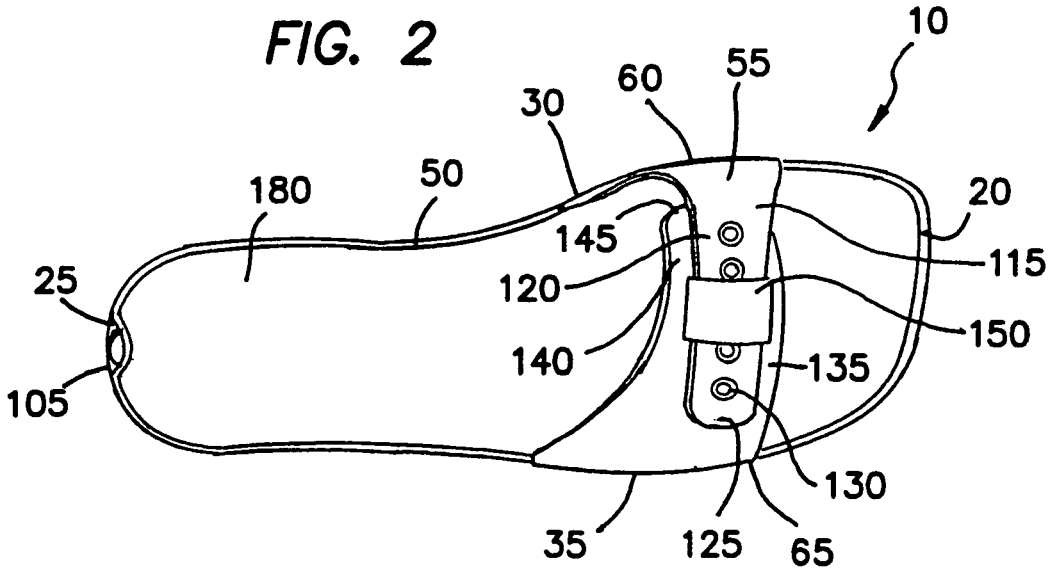

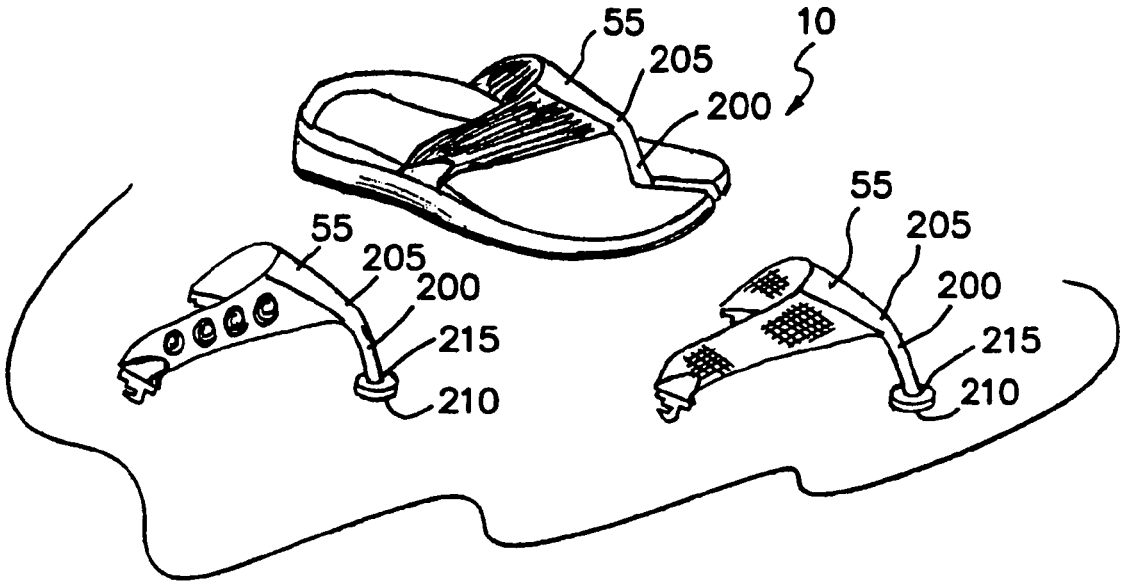
FIG. 5
FIG. 6
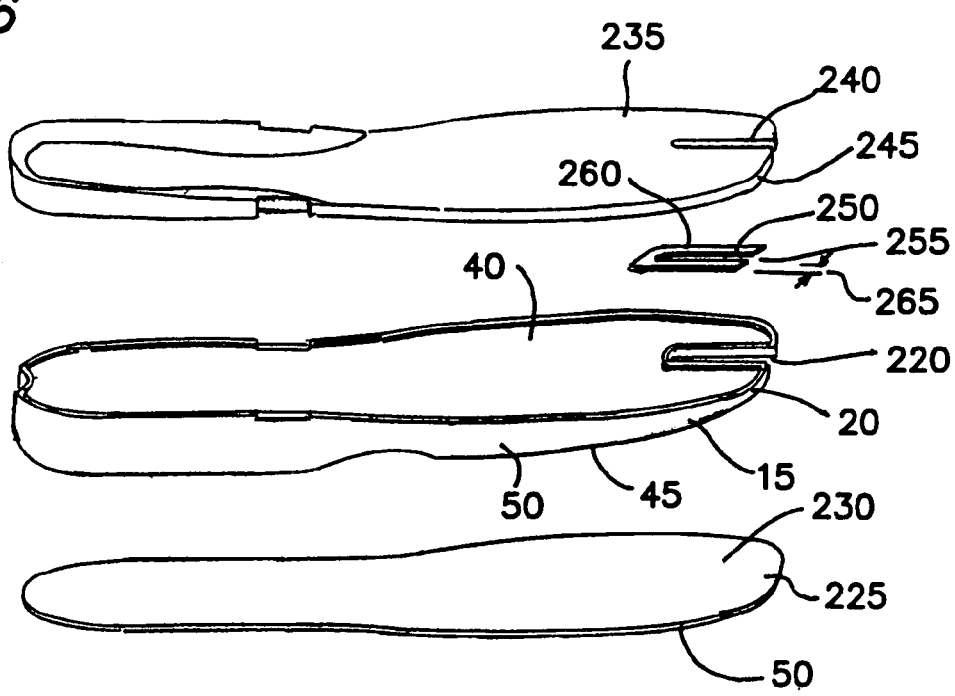

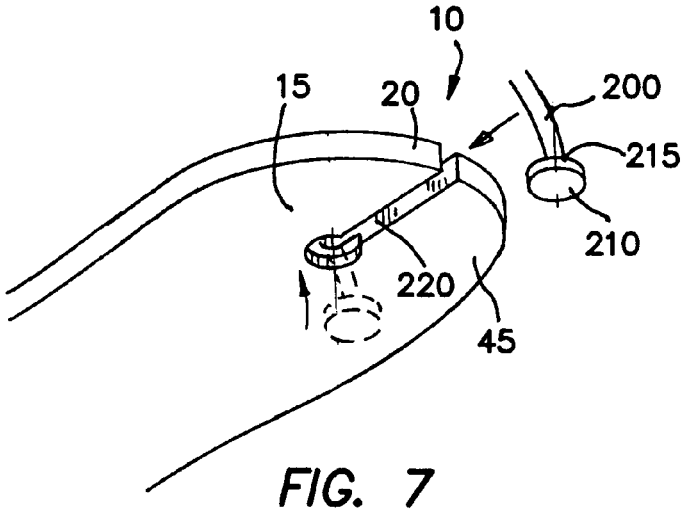
FIG. 7
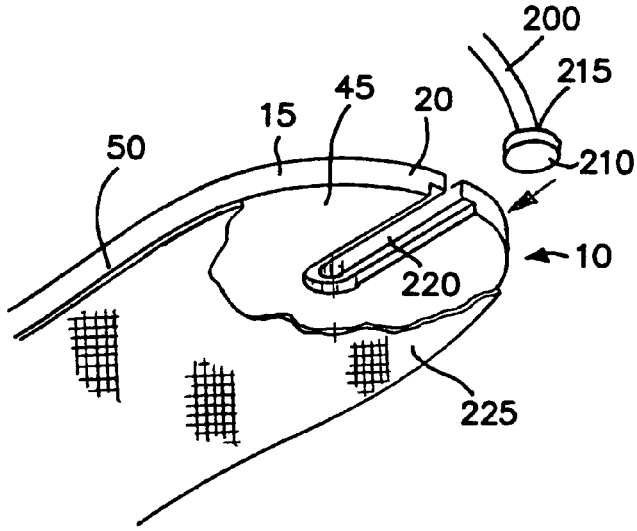
FIG. 8
FIG. 9
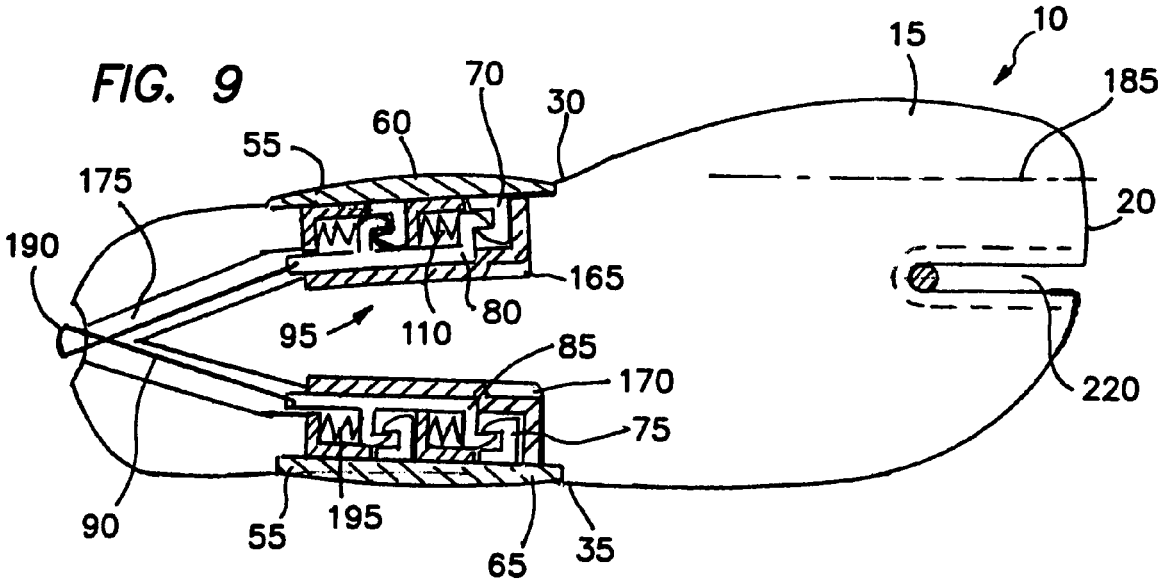

SANDAL WITH INTERCHANGEABLE UPPER

RELATED APPLICATION

This application is a continuation-in-part of non-provisional application Ser. No. 10/000,979, filed Oct. 30, 2001 now U.S. Pat. No. 6,763,614, which is a continuation-in-part of non-provisional application Ser. No. 09/605,418, filed Jun. 27, 2000 now U.S. Pat. 6,351,897.

FIELD OF INVENTION

The present invention relates to the field of shoes and foot coverings; more particularly, to sandals providing a unique system for interchanging the sandal uppers for models of diverse styles.

BACKGROUND OF THE INVENTION

As fashion trends change, versatility in wardrobe becomes more important. At the same time, many fashion-conscious individuals have relatively limited budgets. To address such contrasting needs, accessories that can be used for a variety of different "looks" or fashion statements become more desirable. A shoe or sandal that can accommodate a variety of uppers of different designs will appeal to the cost conscious buyer with an eye toward fashion. Toward this end, various designs for sandals and athletic shoes, and more particularly designs for shoe and sandal fastening and closure systems have been developed.

U.S. Pat. No. 5,557,866, issued to Prengler on Sep. 24, 1996, illustrates athletic footwear having a hinged rear entry and associated fastening system. U.S. Pat. No. 4,616,432 issued to Bunch et al. on Oct. 14, 1986 shows an athletic shoe with a lace closure disposed along the side of the shoe rather than in a central location. U.S. Pat. No. 4,811,497, issued to Ciudad on Mar. 14, 1989, describes a sport shoe incorporating a series of flexible strips on the vamp of the shoe connected together with elastic material, providing a lace-less entry system. U.S. Pat. No. 5,177,882, issued to Berger on Jan. 12, 1993 illustrates a shoe with a central fastener used to secure a rigid instep cover that is drawn to the shoe upper with a series of cables.

In addition to these various closure mechanisms, a number of patents address methods for attaching the shoe upper to the sole. U.S. Pat. No. 2,444,640, issued to Epstein on Jul. 6, 1948, describes a zipper-type closure for attaching different toe enclosing portions of the upper to the sole. A similar system is used in U.S. Pat. No. 2,200,080, issued to Fein on May 7, 1940, to attach the entire upper to the sole of the shoe. U.S. Pat. No. 3,204,346, issued to Lockard et al. on Sep. 7, 1965, illustrates a groove and matching, sliding projection system for attaching the upper to the sole portion.

It is an objective of the present invention to provide a sandal that is easily adjustable to the wearer's toes and instep. It is a further objective of the invention to provide a means for the wearer to quickly change the sandal upper as desired. It is yet a further objective of the invention to provide a sandal with a unique and attractive appearance. While the prior art shoes and sandals examined provide a variety of useful features, none answer the requirements of the present invention.

SUMMARY OF THE INVENTION (1) The sandal with interchangeable upper of the present invention incorporates a number of novel features which, taken together, address all of the objectives stated above. The sandal may be constructed from the following components. A sole portion is provided. The sole portion has a forward end, an after end, an inner edge, an outer edge, an upper surface, a lower surface and an outer perimeter. An instep enclosing section is provided. The instep enclosing section has a first side edge and a second side edge. The instep enclosing section is removably attached at the first and second side edges adjacent the inner and outer edges of the sole portion, respectively. When the instep enclosing section is removed from the sole portion, a second instep enclosing section can be substituted for the first instep enclosing section.

(2) In a variant of the invention, at least one first side hook is provided. The first side hook is attached adjacent the first side edge of the instep enclosing section. At least one second side hook is provided. The second side hook is attached adjacent the second side edge of the instep enclosing section. A first hook engager is provided. The first hook engager is attached adjacent the inner edge of the sole portion and is sized, shaped and disposed to removably engage the at least one first side hook. A second hook engager is provided. The second hook engager is attached adjacent the outer edge of the sole portion and is sized, shaped and disposed to removably engage the at least one second side hook. At least one engager actuator is provided. The engager actuator is attached to at least one of the first and second hook engagers. The actuator moves the engagers from a first, engaging position to a second disengaging position and is operable from at least one point on the outer perimeter of the sole portion. A return mechanism is provided. The return mechanism urges the first and second hook engagers from the second position to the first position.

(3) In another variant, the instep enclosing section further includes a first side section. The first side section includes the first side edge, a first connecting portion extending outwardly from the first side edge to a first end and a first connector spaced inwardly from the first end. A second side section is provided. The second side section includes the second side edge, a second connecting portion extending outwardly from the second side edge to a second end and a mating second connector spaced inwardly from the second end. When the first connector is attached to the second, mating connector, the sandal is adjusted to a foot of a wearer.

(4) In still another variant, the sole portion further includes first and second side pockets. The side pockets are sized, shaped and disposed to receive the first and second hook engagers, respectively. At least one engager actuator channel is provided. The channel is sized, shaped and disposed to receive the engager actuator. A foot pad is provided. The foot pad attaches to the upper surface of the sole portion, is sized and shaped to fit substantially within the outer perimeter of the sole portion and to enclose the first and second side pockets and the engager actuator channel. When the foot pad is attached to the sole portion, the first and second hook engagers and the engager actuator will be protected from dirt and debris.

(5) In yet another variant, the at least one first side hook and the at least one second side hook are oriented parallel to a plane of the sole portion.

(6) In a further variant, the at least one first side hook and the at least one second side hook are oriented orthogonally to a plane of the sole portion.

(7) In still a further variant, one engager actuator is connected to each of the first and second hook engagers.

(8) In another variant of the invention, one engager actuator is connected to the first hook engager and the second hook engager.

(9) In still another variant, the engager actuator terminates in either of a loop and a handle for pulling the engager actuator.

(10) In yet another variant, the return mechanism further includes at least one compression spring.

(11) In a further variant, the return mechanism further includes at least one tension spring.

(12) In still a further variant, the instep enclosing section further includes a toe-separating portion. The toe-separating portion extends forwardly from a central point of the instep enclosing section and downwardly toward the sole portion and terminates in a retaining post mounted orthogonally to a distal end of the toe-separating portion. A keyway is provided. The keyway is located at the forward end of the sole portion and is sized and shaped to fit slidably about the distal end of the toe-separating portion. The lower surface of the sole portion is relieved on either side of the keyway to fit slidably about the retaining post. When the distal end of the toe-separating portion is inserted into the keyway, the retaining post will secure the toe-separating portion to the sole portion.

(13) In yet a further variant, a tread pad is provided. The tread pad has substantially the outer perimeter of the sole portion, is attached to the lower surface of the sole portion and provides a lower closure for the keyway. When the distal end of the toe-separating portion is inserted into the keyway, the retaining post will be protected from a ground surface.

(14) In another variant of the invention, at least one first side hook is provided. The first side hook is attached adjacent the first side edge of the instep enclosing section. At least one second side hook is provided. The second side hook is attached adjacent the second side edge of the instep enclosing section. A first hook engager is provided. The first hook engager is attached adjacent the inner edge of the sole portion and is sized, shaped and located to removably engage the at least one first side hook. A second hook engager is provided. The second hook engager is attached adjacent the outer edge of the sole portion and is sized, shaped and located to removably engage the at least one second side hook. At least one engager actuator is provided. The engager actuator is attached to at least one of the first and second hook engagers. The actuator moves the engagers from a first, engaging position to a second disengaging position and is operable from at least one point on the outer perimeter of the sole portion. A return mechanism is provided. The return mechanism urges the first and second hook engagers from the second position to the first position.

(15) In still another variant, the sole portion further includes first and second side pockets. The side pockets are sized, shaped and located to receive the first and second hook engagers, respectively. At least one engager actuator channel is provided. The channel is sized, shaped and located to receive the engager actuator. A foot pad is provided. The foot pad is attached to the upper surface of the sole portion, is sized and shaped to fit substantially within the outer perimeter of the sole portion and to enclose the first and second side pockets and the engager actuator channel. When the foot pad is attached to the sole portion, the first and second hook engagers and the engager actuator will be protected from dirt and debris.

(16) In yet another variant, the at least one first side hook and the at least one second side hook are oriented parallel to a plane of the sole portion.

(17) In a further variant, the at least one first side hook and the at least one second side hook are oriented orthogonally to a plane of the sole portion.

(18) In still a further variant, one engager actuator is connected to each of the first and second hook engagers.

(19) In yet a further variant, one engager actuator is connected to the first hook engager and the second hook engager.

(20) In another variant of the invention, the engager actuator terminates in either a loop or a handle for pulling the engager actuator.

(21) In still another variant, the return mechanism further includes at least one compression spring.

(22) In yet another variant, the return mechanism further includes at least one tension spring.

(23) In a further variant, the instep enclosing section further includes a toe separating portion. The toe separating portion extends forwardly from a central point of the instep enclosing section, extends downwardly toward the sole portion and terminates in a retaining post mounted orthogonally to a distal end of the toe separating portion. A keyway is provided. The keyway is located at the forward end of the sole portion and is sized and shaped to fit slidably about the retaining post. A tread pad is provided. The tread pad has substantially the outer perimeter of the sole portion, is attached to the lower surface of the sole portion and provides a lower closure for the keyway. A foot pad is provided. The foot pad attaches to the upper surface of the sole portion, is sized and shaped to fit substantially within the outer perimeter of the sole portion and has a first opening at a forward end. The first opening is sized and shaped to fit slidably about the distal end of the toe separating portion and is substantially aligned with the keyway. When the retaining post is inserted into the keyway, the foot pad will secure the toe separating portion to the sole portion.

(24) In still a further variant, a reinforcing tab is provided. The reinforcing tab is formed of rigid, planar material, has a second opening substantially similar to the first opening in the foot pad and has material surrounding the opening of a first predetermined width. The reinforcing tab is attached between the sole portion and the foot pad over the keyway. When upward pressure is applied to the toe separating portion, the reinforcing tab will prevent the retaining post from passing through the first opening.

(25) In yet a further variant, at least one first side hook is provided. The first side hook is attached adjacent the first side edge of the instep enclosing section. At least one second side hook is provided. The second side hook is attached adjacent the second side edge of the instep enclosing section. A first hook engager is provided. The first hook engager is attached adjacent the inner edge of the sole portion and is sized, shaped and disposed to removably engage the at least one first side hook. A second hook engager is provided. The second hook engager is attached adjacent the outer edge of the sole portion and is sized, shaped and disposed to removably engage the at least one second side hook. At least one engager actuator is provided. The engager actuator is attached to at least one of the first and second hook engagers, moves the engagers from a first, engaging position to a second disengaging position and is operable from at least one point on the outer perimeter of the sole portion. A return mechanism is provided. The return mechanism urges the first and second hook engagers from the second position to the first position.

(26) In another variant of the invention, the sole portion further includes first and second side pockets. The side pockets are sized, shaped and located to receive the first and second hook engagers. At least one engager actuator channel is provided. The channel is sized, shaped and located to receive the engager actuator. The foot pad encloses the first and second side pockets and the engager actuator channel. When the foot pad is attached to the sole portion, the first and second hook engagers and the engager actuator are protected from dirt and debris.

(27) In still another variant, the at least one first side hook and the at least one second side hook are oriented parallel to a plane of the sole portion.

(28) In yet another variant, the at least one first side hook and the at least one second side hook are oriented orthogonally to a plane of the sole portion.

(29) In a further variant, one engager actuator is connected to each of the first and second hook engagers.

(30) In still a further variant, one engager actuator is connected to the first hook engager and the second hook engager.

(31) In yet a further variant the engager actuator terminates in either of a loop and a handle for pulling the engager actuator.

(32) In another variant of the invention, the return mechanism further includes at least one compression spring.

(33) In a final variant, the return mechanism further includes at least one tension spring.

An appreciation of the other aims and objectives of the present invention and an understanding of it may be achieved by referring to the accompanying drawings and the detailed description of a preferred embodiment.

DESCRIPTION OF THE DRAWINGS

FIG. 1 is a disassembled perspective view of a first embodiment of the sandal of the present invention;

FIG. 2 is a plan view of the FIG. 1 embodiment illustrating the removable upper attached to the sandal;

FIG. 5 is a disassembled perspective view of a second embodiment of the sandal of the present invention, illustrating alternative sandal uppers;

FIG. 6 is a disassembled perspective view of the sole portion of the FIG. 5 embodiment, illustrating the foot pad, the tread pad and the reinforcing tab;

FIG. 7 is a perspective view of a third embodiment of the sandal of the present invention illustrating the retaining post set into the sole portion;

FIG. 8 is a perspective view of a fourth embodiment of the sandal illustrating the retaining post retained by a tread pad;

FIG. 9 is a cross-sectional top view of the FIG. 8 embodiment illustrating the hook engagers in an engaging position;

Figure 3:
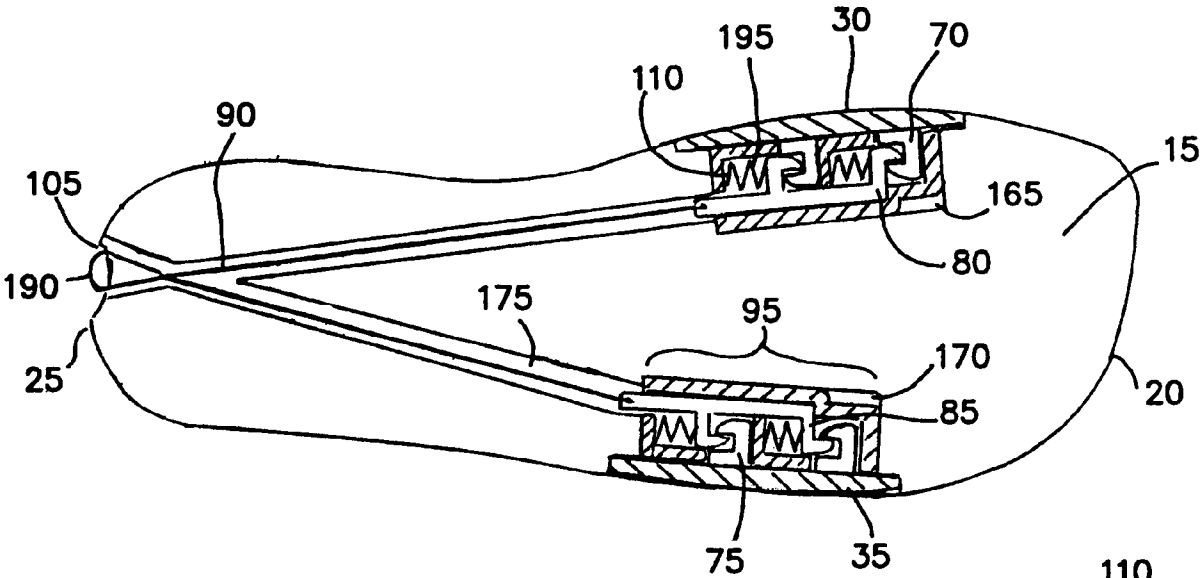
FIG. 3 is a cross-sectional top view of the FIG. 1 embodiment illustrating the attachment of the removable upper to the sole portion of the sandal using the side hooks and hook engagers.

DETAILED DESCRIPTION OF THE PREFERRED EMBODIMENT (1) The sandal with interchangeable upper 10, as illustrated in FIGS. 1–4 may be constructed from the following components. A sole portion 15 is provided. The sole portion 15 has a forward end 20, an after end 25, an inner edge 30, an outer edge 35, an upper surface 40, a lower surface 45 and an outer perimeter 50. An instep enclosing section 55 is provided. The instep enclosing section 55 has a first side edge 60 and a second side edge 65. The instep enclosing section 55 is removably attached at the first 60 and second 65 side edges adjacent the inner 30 and outer 35 edges of the sole portion 15, respectively. When the instep enclosing section 55 is removed from the sole portion 15, a second instep enclosing section 55 can be substituted for the first instep enclosing section 55.

(2) In a variant of the invention, at least one first side hook 70 is provided. The first side hook 70 is attached adjacent the first side edge 60 of the instep enclosing section 55. At least one second side hook 75 is provided. The second side hook 75 is attached adjacent the second side edge 65 of the instep enclosing section 55. A first hook engager 80 is provided. The first hook engager 80 is attached adjacent the inner edge 30 of the sole portion 15 and is sized, shaped and disposed to removably engage the at least one first side hook 70. A second hook engager 85 is provided. The second hook engager 85 is attached adjacent the outer edge 35 of the sole portion 15 and is sized, shaped and disposed to removably engage the at least one second side hook 75. At least one engager actuator 90 is provided. The engager actuator 90 is attached to at least one of the first 80 and second 85 hook engagers. The actuator 90 moves the engagers 80, 85 from a first, engaging position 95 to a second disengaging position 100 and is operable from at least one point 105 on the outer perimeter 50 of the sole portion 15. A return mechanism 110 is provided. The return mechanism 110 urges the first 80 and second 85 hook engagers from the second position 100 to the first position 95.

(3) In another variant, as illustrated in FIG. 2, the instep enclosing section 55 further includes a first side section 115. The first side section 115 includes the first side edge 60, a first connecting portion 120 extending outwardly from the first side edge 60 to a first end 125 and a first connector 130 spaced inwardly from the first end 125. A second side section 135 is provided. The second side section 135 includes the second side edge 65, a second connecting portion 140 extending outwardly from the second side edge 65 to a second end 145 and a mating second connector 150 spaced inwardly from the second end 145. When the first connector 130 is attached to the second, mating connector 150, the sandal 10 is adjusted to a foot (not shown) of a wearer (not shown).

(4) In still another variant, as illustrated in FIGS. 1–4, the sole portion 15 further includes first 165 and second 170 side pockets. The side pockets 165, 170 are sized, shaped and disposed to receive the first 80 and second 85 hook engagers, respectively. At least one engager actuator channel 175 is provided. The channel 175 is sized, shaped and disposed to receive the engager actuator 90. A foot pad 180 is provided. The foot pad 180 attaches to the upper surface 40 of the sole portion 15, is sized and shaped to fit substantially within the outer perimeter 50 of the sole portion 15 and to enclose the first 165 and second 170 side pockets and the engager actuator channel 175. When the foot pad 180 is attached to the sole portion 15, the first 80 and second 85 hook engagers and the engager actuator 90 will be protected from dirt and debris (not shown).

(5) In yet another variant, the at least one first side hook 70 and the at least one second side hook 75 are oriented parallel to a plane 185 of the sole portion 15.

Figure 10:
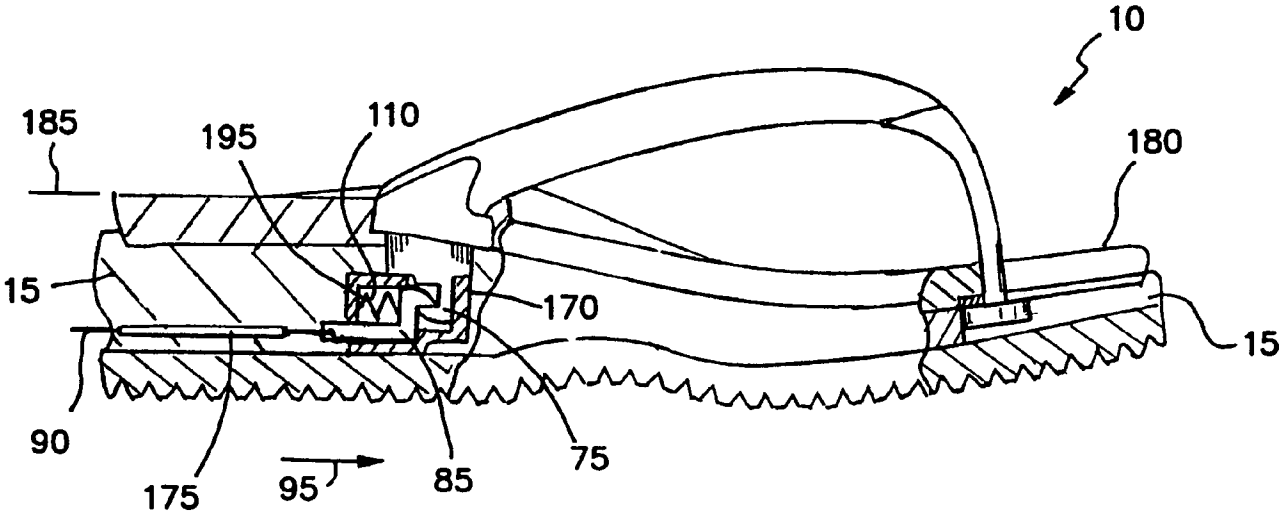
FIG. 10 is a partial side view cutaway of the FIG. 5 embodiment, illustrating vertically oriented hook engagers in the engaging position.
Figure 11:
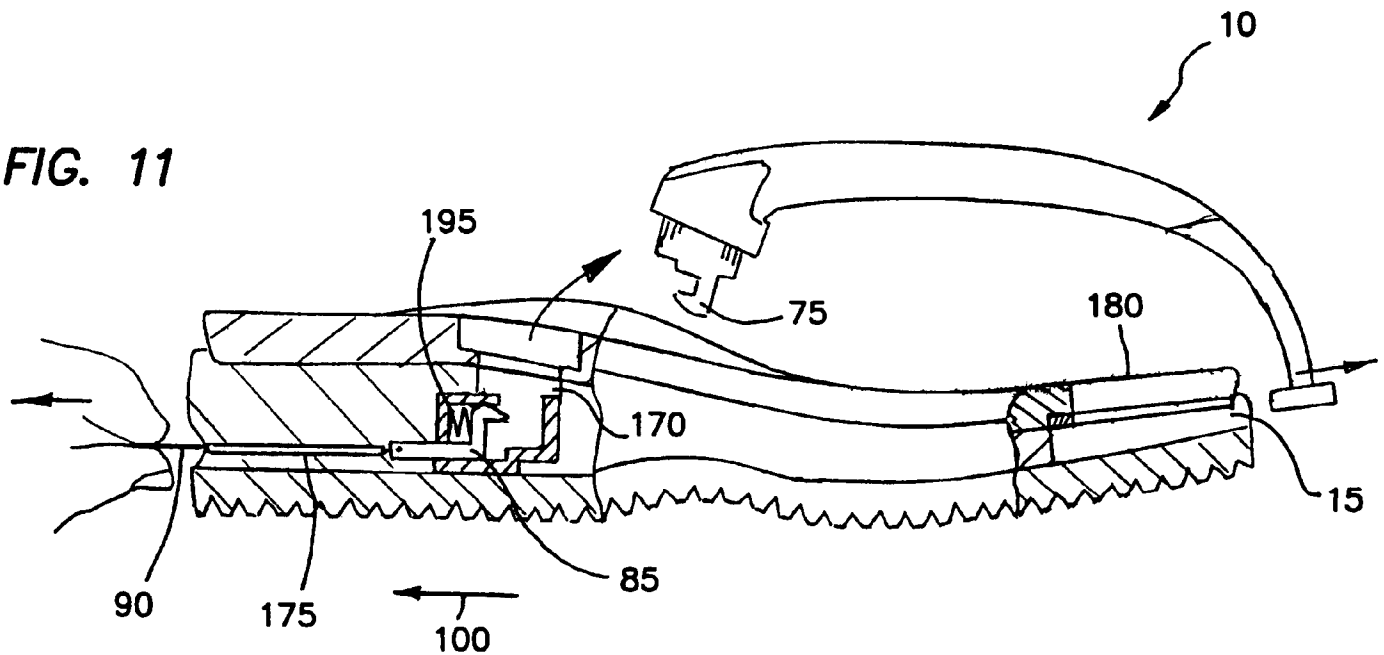
FIG. 11 is a partial side view cutaway of the FIG. 5 embodiment, illustrating vertically oriented hook engagers in the disengaging position.

(6) In a further variant, as illustrated in FIGS. 10 and 11, the at least one first side hook 70 and the at least one second side hook 75 are oriented orthogonally to a plane 185 of the sole portion 15.

(7) In still a further variant, one engager actuator 90 is connected to each of the first 80 and second 85 hook engagers.

(8) In another variant of the invention, one engager actuator 90 is connected to the first hook engager 80 and the second hook engager 85.

Figure 4:
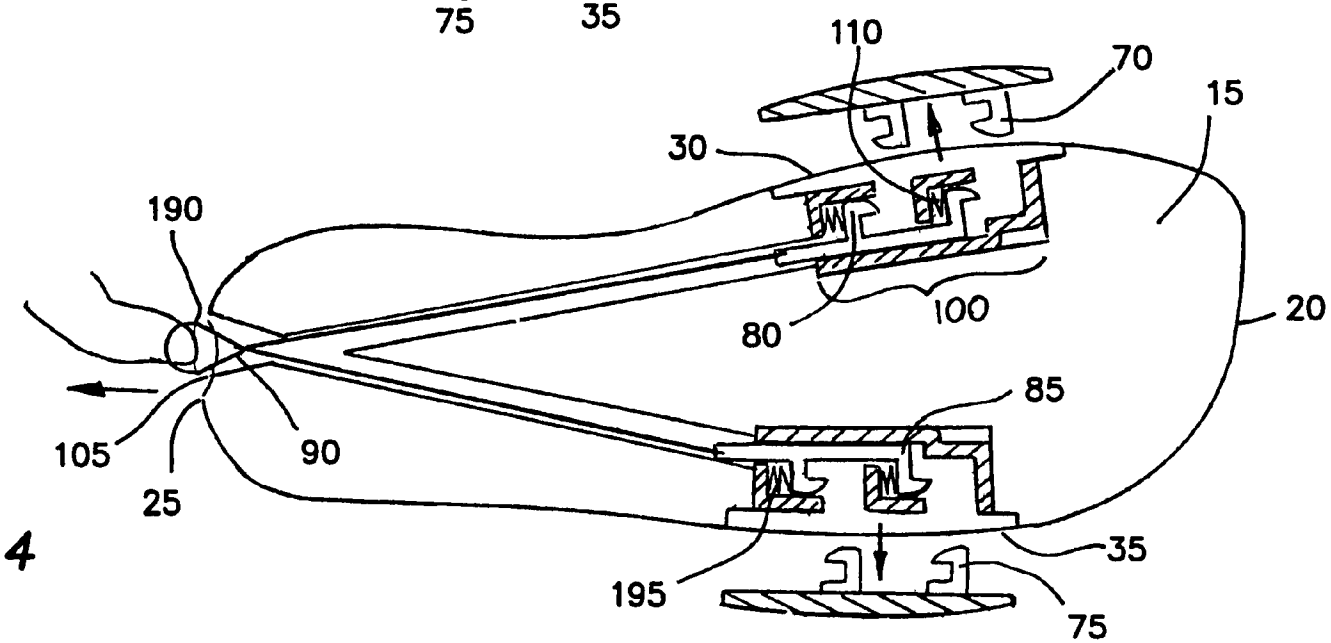
FIG. 4 is a cross-sectional top view of the FIG. 1 embodiment illustrating the removal of the upper from the sole portion of the sandal and illustrating the hook engagers in a disengaging position.

(9) In still another variant, as illustrated in FIGS. 3 and 4, the engager actuator 90 terminates in either of a loop 190 and a handle (not shown) for pulling the engager actuator 90.

(10) In yet another variant, the return mechanism 110 further includes at least one compression spring 195.

(11) In a further variant, the return mechanism 110 further includes at least one tension spring (not shown).

(12) In still a further variant, as illustrated in FIGS. 5–9, the instep enclosing section 55 further includes a toe-separating portion 200. The toe-separating portion 200 extends forwardly from a central point 205 of the instep enclosing section 55 and downwardly toward the sole portion 15 and terminates in a retaining post 210 mounted orthogonally to a distal end 215 of the toe-separating portion 200. A keyway 220 is provided. The keyway 220 is located at the forward end 20 of the sole portion 15 and is sized and shaped to fit slidably about the distal end 215 of the toe-separating portion 200. The lower surface 45 of the sole portion 15 is relieved on either side of the keyway 220 to fit slidably about the retaining post 210. When the distal end 215 of the toe-separating portion 200 is inserted into the keyway 220, the retaining post 210 will secure the toe-separating portion 200 to the sole portion 15.

(13) In yet a further variant, as illustrated in FIG. 6, a tread pad 225 is provided. The tread pad 225 has substantially the outer perimeter 50 of the sole portion 15, is attached to the lower surface 45 of the sole portion 15 and provides a lower closure 230 for the keyway 220. When the distal end 215 of the toe-separating portion 200 is inserted into the keyway 220, the retaining post 210 will be protected from a ground surface (not shown).

(14) In another variant of the invention, as illustrated in FIGS. 9–11, at least one first side hook 70 is provided. The first side hook 70 is attached adjacent the first side edge 60 of the instep enclosing section 55. At least one second side hook 75 is provided. The second side hook 75 is attached adjacent the second side edge 65 of the instep enclosing section 55. A first hook engager 80 is provided. The first hook engager 80 is attached adjacent the inner edge 30 of the sole portion 15 and is sized, shaped and located to removably engage the at least one first side hook 70. A second hook engager 85 is provided. The second hook engager 85 is attached adjacent the outer edge 35 of the sole portion 15 and is sized, shaped and located to removably engage the at least one second side hook 75. At least one engager actuator 90 is provided. The engager actuator 90 is attached to at least one of the first 80 and second 85 hook engagers. The actuator 90 moves the engagers 80, 85 from a first, engaging position 95 to a second disengaging position 100 and is operable from at least one point 105 on the outer perimeter 50 of the sole portion 15. A return mechanism 110 is provided. The return mechanism 110 urges the first 80 and second 85 hook engagers from the second position 100 to the first position 95.

(15) In still another variant, the sole portion 15 further includes first 165 and second 170 side pockets. The side pockets 165, 170 are sized, shaped and located to receive the first 80 and second 85 hook engagers, respectively. At least one engager actuator channel 175 is provided. The channel 175 is sized, shaped and located to receive the engager actuator 90. A foot pad 180 is provided. The foot pad 180 is attached to the upper surface 40 of the sole portion 15, is sized and shaped to fit substantially within the outer perimeter 50 of the sole portion 15 and to enclose the first 165 and second 170 side pockets and the engager actuator channel 175. When the foot pad 180 is attached to the sole portion 15, the first 80 and second 85 hook engagers and the engager actuator 90 will be protected from dirt and debris.

(16) In yet another variant, as illustrated in FIG. 9, the at least one first side hook 70 and the at least one second side hook 75 are oriented parallel to a plane of the sole portion.

(17) In a further variant, as illustrated in FIGS. 10 and 11, the at least one first side hook and the at least one second side hook are oriented orthogonally to a plane 185 of the sole portion 15.

(18) In still a further variant, one engager actuator 90 is connected to each of the first 80 and second 85 hook engagers.

(19) In yet a further variant, as illustrated in FIG. 9, one engager actuator 90 is connected to the first hook 80 engager and the second hook engager 85.

(20) In another variant of the invention, the engager actuator 90 terminates in either a loop 190 or a handle not shown) for pulling the engager actuator 90.

(21) In still another variant, as illustrated in FIGS. 9–11, the return mechanism 110 further includes at least one compression spring 195.

(22) In yet another variant, the return mechanism 110 further includes at least one tension spring (not shown).

(23) In a further variant, as illustrated in FIGS. 5 and 6, the instep enclosing section 55 further includes a toe separating portion 200. The toe separating portion 200 extends forwardly from a central point 205 of the instep enclosing section 55, extends downwardly toward the sole portion 15 and terminates in a retaining post 210 mounted orthogonally to a distal end 215 of the toe separating portion 200. A keyway 220 is provided. The keyway 220 is located at the forward end 20 of the sole portion 15 and is sized and shaped to fit slidably about the retaining post 210. A tread pad 225 is provided. The tread pad 225 has substantially the outer perimeter 50 of the sole portion 15, is attached to the lower surface 45 of the sole portion 15 and provides a lower closure 230 for the keyway 220. A notched foot pad 235 is provided. The foot pad 235 attaches to the upper surface 40 of the sole portion 15, is sized and shaped to fit substantially within the outer perimeter 50 of the sole portion 15 and has a first opening 240 at a forward end 245. The first opening 240 is sized and shaped to fit slidably about the distal end 215 of the toe separating portion 200 and is substantially aligned with the keyway 220. When the retaining post 210 is inserted into the keyway 220, the foot pad 235 will secure the toe separating portion 200 to the sole portion 15.

(24) In still a further variant, as illustrated in FIG. 6, a reinforcing tab 250 is provided. The reinforcing tab 250 is formed of rigid, planar material, has a second opening 255 substantially similar to the first opening 240 in the foot pad 235 and has material 260 surrounding the opening 255 of a first predetermined width 265. The reinforcing tab 250 is attached between the sole portion 15 and the foot pad 235 over the keyway 220. When upward pressure is applied to the toe separating portion 200, the reinforcing tab 250 will prevent the retaining post 210 from passing through the first opening 240.

(25) In yet a further variant, as illustrated in FIGS. 9–11, at least one first side hook 70 is provided. The first side hook 70 is attached adjacent the first side edge 60 of the instep enclosing section 55. At least one second side hook 75 is provided. The second side hook 75 is attached adjacent the second side edge 65 of the instep enclosing section 55. A first hook engager 80 is provided. The first hook engager 80 is attached adjacent the inner edge 30 of the sole portion 15 and is sized, shaped and disposed to removably engage the at least one first side hook 70. A second hook engager 85 is provided. The second hook engager 85 is attached adjacent the outer edge 35 of the sole portion 15 and is sized, shaped and disposed to removably engage the at least one second side hook 75. At least one engager actuator 90 is provided. The engager actuator 90 is attached to at least one of the first 80 and second 85 hook engagers, moves the engagers 80, 85 from a first, engaging position 95 to a second disengaging position 100 and is operable from at least one point 105 on the outer perimeter 50 of the sole portion 15. A return mechanism 110 is provided. The return mechanism 110 urges the first 80 and second 85 hook engagers from the second position 100 to the first position 95.

(26) In another variant of the invention, the sole portion 15 further includes first 165 and second 170 side pockets. The side pockets 165, 170 are sized, shaped and located to receive the first 80 and second 85 hook engagers. At least one engager actuator channel 175 is provided. The channel 175 is sized, shaped and located to receive the engager actuator 90. The foot pad 235 encloses the first 165 and second 170 side pockets and the engager actuator channel 175. When the foot pad 235 is attached to the sole portion 15, the first 80 and second 85 hook engagers and the engager actuator 90 are protected from dirt and debris.

(27) In still another variant, as illustrated in FIG. 9, the at least one first side hook 70 and the at least one second side hook 75 are oriented parallel to a plane 185 of the sole portion 15.

(28) In yet another variant, as illustrated in FIGS. 10 and 11, the at least one first side hook 70 and the at least one second side hook 75 are oriented orthogonally to a plane 185 of the sole portion 15.

(29) In a further variant, one engager actuator 90 is connected to each of the first 80 and second 85 hook engagers.

(30) In still a further variant, as illustrated in FIG. 9, one engager actuator 90 is connected to the first hook engager 80 and the second hook engager 85.

(31) In yet a further variant the engager actuator 90 terminates in either of a loop 190 and a handle (not shown) for pulling the engager actuator 90.

(32) In another variant of the invention, as illustrated in FIGS. 9–11, the return mechanism 110 further includes at least one compression spring 195.

(33) In a final variant, the return mechanism 110 further includes at least one tension spring (not shown).

An appreciation of the other aims and objectives of the present invention and an understanding of it may be achieved by referring to the accompanying drawings and the detailed description of a preferred embodiment.

The invention claimed is:

1. A sandal comprising:

a sole portion, said sole portion having a forward end, an after end, an inner edge, an outer edge, an upper surface, a lower surface and an outer perimeter;

an instep enclosing section, said instep enclosing section having a first side edge and a second side edge;

said instep enclosing section being removably attached at said first and second side edges adjacent said inner and outer edges of said sole portion, respectively;

at least one first side hook, said first side hook being attached adjacent said first side edge of said instep enclosing section;

at least one second side hook, said second side hook being attached adjacent said second side edge of said instep enclosing section;

a first hook engager, said first hook engager attached adjacent said inner edge of said sole portion and being sized, shaped and disposed to removably engage said at least one first side hook;

a second hook engager, said second hook engager attached adjacent said outer edge of said sole portion and being sized, shaped and disposed to removably engage said at least one second side hook;

at least one engager actuator, said engager actuator being attached to at least one of said first and second hook engagers, moving said engagers from a first, engaging position to a second disengaging position and being operable from at least one point on said outer perimeter of said sole portion; and a return mechanism, said return mechanism urging said first and second hook engagers from said second position to said first position; and whereby, when said instep enclosing section is removed from said sole portion, a second instep enclosing section can be substituted for the first instep enclosing section.

2. The sandal, as described in claim 1, wherein said instep enclosing section further comprises:

a first side section, said first side section comprising said first side edge, a first connecting portion extending outwardly from said first side edge to a first end and a first connector spaced inwardly from said first end;

a second side section, said second side section comprising said second side edge, a second connecting portion extending outwardly from said second side edge to a second end and a mating second connector spaced inwardly from said second end; and whereby, when said first connector is attached to said second, mating connector, said sandal is adjusted to a foot of a wearer.

3. The sandal, as described in claim 1, wherein said sole portion further comprises:

first and second side pockets, said side pockets being sized, shaped and disposed to receive said first and second hook engagers, respectively;

at least one engager actuator channel, said channel being sized, shaped and disposed to receive said engager actuator;

a foot pad, said foot pad attaching to said upper surface of said sole portion, being sized and shaped to fit substantially within said outer perimeter of said sole portion and to enclose said first and second side pockets and said engager actuator channel; and whereby, when said foot pad is attached to said sole portion, said first and second hook engagers and said engager actuator will be protected from dirt and debris.

4. The sandal, as described in claim 1, wherein said at least one first side hook and said at least one second side hook are oriented parallel to a plane of said sole portion.

5. The sandal, as described in claim 1, wherein said at least one first side hook and said at least one second side hook are oriented orthogonally to a plane of said sole portion.

6. The sandal, as described in claim 1, wherein one engager actuator is connected to each of said first and second hook engagers.

7. The sandal, as described in claim 1, wherein one engager actuator is connected to said first hook engager and said second hook engager.

8. The sandal, as described in claim 1, wherein said engager actuator terminates in either of a loop and a handle for pulling said engager actuator.

9. The sandal, as described in claim 1, wherein said return mechanism further comprises at least one compression spring.

10. The sandal, as described in claim 1, wherein said return mechanism further comprises at least one tension spring.

11. The sandal, as described in claim 1, wherein said instep enclosing section further comprises:

a toe separating portion, said toe separating portion extending forwardly from a central point of said instep enclosing section, extending downwardly toward said sole portion and terminating in a retaining post mounted orthogonally to a distal end of said toe separating portion;

a keyway, said keyway disposed at said forward end of said sole portion and being sized and shaped to fit slidably about said distal end of said toe separating portion;

said lower surface of said sole portion being relieved on either side of said keyway to fit slidably about said retaining post; and whereby, when said distal end of said toe separating portion is inserted into said keyway, said retaining post will secure said toe separating portion to said sole portion.

12. The sandal, as described in claim 11, further comprising:

a tread pad, said tread pad having substantially said outer perimeter of said sole portion, being attached to said lower surface of said sole portion and providing a lower closure for said keyway; and whereby, when said distal end of said toe separating portion is inserted into said keyway, said retaining post will be protected from a ground surface.

13. The sandal, as described in claim 11, further comprising:

at least one first side hook, said first side hook being attached adjacent said first side edge of said instep enclosing section;

at least one second side hook, said second side hook being attached adjacent said second side edge of said instep enclosing section;

a first hook engager, said first hook engager attached adjacent said inner edge of said sole portion and being sized, shaped and disposed to removably engage said at least one first side hook;

a second hook engager, said second hook engager attached adjacent said outer edge of said sole portion and being sized, shaped and disposed to removably engage said at least one second side hook;

at least one engager actuator, said engager actuator being attached to at least one of said first and second hook engagers, moving said engagers from a first, engaging position to a second disengaging position and being operable from at least one point on said outer perimeter of said sole portion; and a return mechanism, said return mechanism urging said first and second hook engagers from said second position to said first position.

14. The sandal, as described in claim 13, wherein said sole portion further comprises:

first and second side pockets, said side pockets being sized, shaped and disposed to receive said first and second hook engagers, respectively;

at least one engager actuator channel, said channel being sized, shaped and disposed to receive said engager actuator;

a foot pad, said foot pad attaching to said upper surface of said sole portion, being sized and shaped to fit substantially within said outer perimeter of said sole portion and to enclose said first and second side pockets and said engager actuator channel; and whereby, when said foot pad is attached to said sole portion, said first and second hook engagers and said engager actuator will be protected from dirt and debris.

15. The sandal, as described in claim 13, wherein said at least one first side hook and said at least one second side hook are oriented parallel to a plane of said sole portion.

16. The sandal, as described in claim 13, wherein said at least one first side hook and said at least one second side hook are oriented orthogonally to a plane of said sole portion.

17. The sandal, as described in claim 13, wherein one engager actuator is connected to each of said first and second hook engagers.

18. The sandal, as described in claim 13, wherein one engager actuator is connected to said first hook engager and said second hook engager.

19. The sandal, as described in claim 13, wherein said engager actuator terminates in either of a loop and a handle for pulling said engager actuator.

20. The sandal, as described in claim 13, wherein said return mechanism further comprises at least one compression spring.

21. The sandal, as described in claim 13, wherein said return mechanism further comprises at least one tension spring.

22. The sandal, as described in claim 1, wherein said instep enclosing section further comprises:

a toe separating portion, said toe separating portion extending forwardly from a central point of said instep enclosing section, extending downwardly toward said sole portion and terminating in a retaining post mounted orthogonally to a distal end of said toe separating portion;

a keyway, said keyway disposed at said forward end of said sole portion and being sized and shaped to fit slidably about said retaining post;

a tread pad, said tread pad having substantially said outer perimeter of said sole portion, being attached to said lower surface of said sole portion and providing a lower closure for said keyway;

a foot pad, said foot pad attaching to said upper surface of said sole portion, being sized and shaped to fit substantially within said outer perimeter of said sole portion, having a first opening at a forward end, said first opening being sized and shaped to fit slidably about said distal end of said toe separating portion and being substantially aligned with said keyway; and whereby, when said retaining post is inserted into said keyway, said foot pad will secure said toe separating portion to said sole portion.

23. The sandal, as described in claim 22, further comprising:

a reinforcing tab, said reinforcing tab being formed of rigid, planar material, having a second opening substantially similar to said first opening in said foot pad and having material surrounding said opening of a first predetermined width;

said reinforcing tab being attached between said sole portion and said foot pad over said keyway; and whereby, when upward pressure is applied to said toe separating portion, said reinforcing tab will prevent said retaining post from passing through said first opening.

24. The sandal, as described in claim 22, further comprising:

at least one first side hook, said first side hook being attached adjacent said first side edge of said instep enclosing section;

at least one second side hook, said second side hook being attached adjacent said second side edge of said instep enclosing section;

a first hook engager, said first hook engager attached adjacent said inner edge of said sole portion and being sized, shaped and disposed to removably engage said at least one first side hook;

a second hook engager, said second hook engager attached adjacent said outer edge of said sole portion and being sized, shaped and disposed to removably engage said at least one second side hook;

at least one engager actuator, said engager actuator being attached to at least one of said first and second hook engagers, moving said engagers from a first, engaging position to a second disengaging position and being operable from at least one point on said outer perimeter of said sole portion; and a return mechanism, said return mechanism urging said first and second hook engagers from said second position to said first position.

25. The sandal, as described in claim 24, wherein said sole portion further comprises:

first and second side pockets, said side pockets being sized, shaped and disposed to receive said first and second hook engagers, respectively;

at least one engager actuator channel, said channel being sized, shaped and disposed to receive said engager actuator;

said foot pad enclosing said first and second side pockets and said engager actuator channel; and whereby, when said foot pad is attached to said sole portion, said first and second hook engagers and said engager actuator will be protected from dirt and debris.

26. The sandal, as described in claim 24, wherein said at least one first side hook and said at least one second side hook are oriented parallel to a plane of said sole portion.

27. The sandal, as described in claim 24, wherein said at least one first side hook and said at least one second side hook are oriented orthogonally to a plane of said sole portion.

28. The sandal, as described in claim 24, wherein one engager actuator is connected to each of said first and second hook engagers.

29. The sandal, as described in claim 24, wherein one engager actuator is connected to said first hook engager and said second hook engager.

30. The sandal, as described in claim 24, wherein said engager actuator terminates in either of a loop and a handle for pulling said engager actuator.

31. The sandal, as described in claim 24, wherein said return mechanism further comprises at least one compression spring.

32. The sandal, as described in claim 24, wherein said return mechanism further comprises at least one tension spring.

* * * * *